United States Patent [19]

Nakamatsu

[11] 4,123,056

[45] Oct. 31, 1978

[54] GOLFCLUB

[76] Inventor: Yoshiro Nakamatsu, 6-31-10,, Shimouma, Setagaya-ku, Tokyo, Japan

[21] Appl. No.: 746,263

[22] Filed: Nov. 30, 1976

[30] Foreign Application Priority Data

Jun. 26, 1976 [JP] Japan ..... 51-74990
Aug. 30, 1976 [JP] Japan ..... 51-102625

[51] Int. Cl.[2] ..... A63B 53/04
[52] U.S. Cl. ..... 273/78
[58] Field of Search ..... 273/77 R, 78, 167 R, 273/167 J, 173, 80 C, 193 R; D34/5 GH, 5 GC

[56] References Cited

U.S. PATENT DOCUMENTS

| | | | |
|---|---|---|---|
| D. 204,001 | 3/1966 | Lubin | 273/78 X |
| D. 222,752 | 12/1971 | Cook | 273/78 X |
| D. 228,396 | 9/1973 | Cruger | 273/78 X |
| D. 232,252 | 7/1974 | Cook | 273/78 X |
| D. 234,962 | 4/1975 | Swash | 273/164 X |
| D. 239,186 | 3/1976 | Meissler | 273/167 D X |
| 1,154,490 | 9/1915 | Davis | 273/78 |
| 3,042,405 | 7/1962 | Solheim | 273/78 X |
| 3,061,310 | 10/1962 | Giza | 273/78 |
| 3,319,962 | 5/1967 | Summers | 273/167 G X |
| 3,679,207 | 7/1972 | Florian | 273/78 X |
| 3,851,877 | 12/1974 | Giambazi | 273/78 |

*Primary Examiner*—Richard J. Apley
*Attorney, Agent, or Firm*—Frank J. Jordan

[57] ABSTRACT

A golfclub includes a club head having two connected and opposed members which are spaced from one another whereby one of the members is adapted to strike a golfball such that the member vibrates to produce a sound by which a golfer can judge the area of the club head which strikes the golfball.

4 Claims, 12 Drawing Figures

GOLFCLUB

The present invention relates to a golfclub including a novel and unique club-head producing a vibratory sound as it hits on a golfball.

It is the main object of the present invention to provide a golfclub including a club-head which produces a particular vibratory sound as it hits on a golfball so that a golfer can judge that area of the club-head against which the golfball strikes.

Another object of the present invention is to provide a golfclub including a club-head which can increase a distance through which the hit golfball moves.

Still another object of the present invention is to provide a golfclub including a club-head producing a specific sound which may be felt by a golfer as a pleasant sensation as he hits a golfball by the golfclub.

The present invention will now be described by way of example with reference to the accompanying drawings in which.

Figure 1:
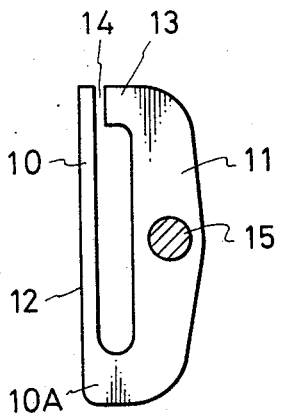
FIG. 1 is a plan view showing a club-head according to the present invention.

A club-head shown in FIG. 1 includes two head members 10 and 11 which are opposed to and spaced away from each other by a predetermined distance. The member 10 has a flat striking face 12 and is thinner in thickness than the other member 11 so that the member 10 can vibrate as the flat striking face thereof strikes a golfball. The head member 10 is connected at one end 10A integrally with the other member 11 with the other end thereof being spaced from the end portion 13 of the head member 11 which extends toward the other end of the head member 10 to define a slit 14 therebetween.

A shaft 15 is connected with the member 11 at the substantially central portion thereof. When a golfer hits a golfball with the club-head by swinging the shaft 15, the head member 10 vibrates to produce a pleasant sound so that the golfer can judge where the golfball strikes according to the produced sound. Moreover, a distance through which the hit golfball moves is increased under the resilient action of the head member 10.

Figure 2:
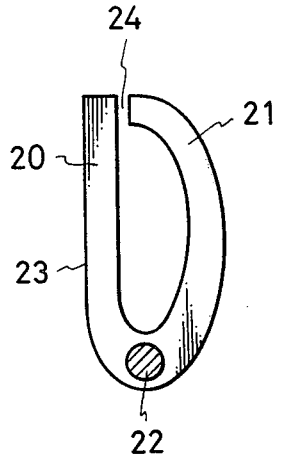
FIG. 2 is a plan view showing another club-head according to the present invention.

FIG. 2 shows another embodiment of a club-head including two head members 20 and 21 connected at one end integrally with each other. A shaft 22 is connected to the connection between these head members 20 and 21. The head member 20 has a flat striking face 23 and is of thickness equal to that of the other head member 21 which is curved with the other end being adjoined to the end of the member 20 to define a slit 24 therebetween.

Figure 3:
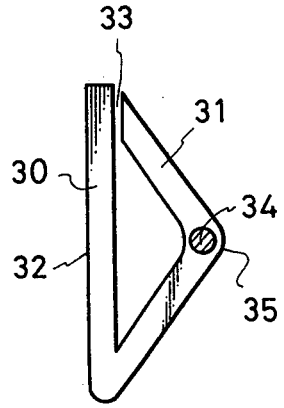
FIG. 3 is a plan view showing still another club-head according to the present invention.

A club-head shown in FIG. 3 has two head members 30 and 31 connected at one end with each other to form a triangle shape. The straight head member 30 has a flat striking face 32 and the other head member 31 is bent at an angle. The other end of the head member 30 is spaced from the end face of the other member 31 to define a slit 33 therebetween. A shaft 24 is connected with the bent portion 25 of the member 31, thus at an apex of the triangle. The shaft 24 may be connected to the connection between the head members 30 and 31.

Figure 4:
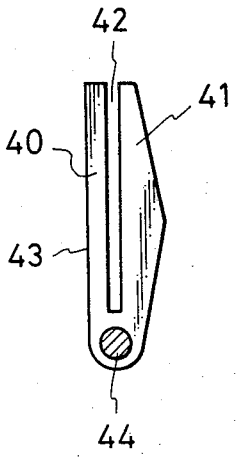
FIG. 4 is a plan view showing further club-head according to the present invention.

FIG. 4 shows another club-head including two head members 40 and 41 connected at one end with each other to define only a slit 42 therebetween. The head member 40 has a flat striking face 43 and is thinner in thickness than that of the other member 41 which increases gradually in thickness toward its central portion. A shaft 44 is connected to the connection between the both head members 40 and 41. However, the shaft 44 may be connected with said central portion of the head member 41.

Figure 5:
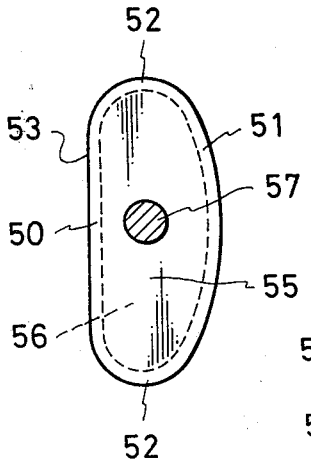
FIG. 5 is a plan view showing still further club-head according to the present invention.
Figure 6:
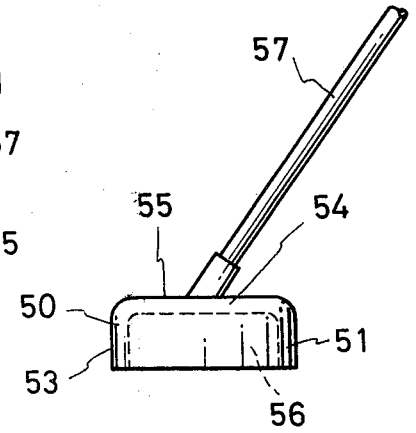
FIG. 6 is a side view of the club-head shown in FIG. 5.

A club-head shown in FIGS. 5 and 6 includes a wall-like head member 50 having a flat butting face 53 and another wall-like head member 51 connected at the opposite ends 52 to said head member 50. The head members 50 and 51 are also connected at their top edges together with each other by means of a top plate 54 which has a substantially flat upper surface 55. The head member 50 and 51 and the top plate 54 form a hollow head portion 56 with the bottom opened. A shaft 57 is connected to the upper surface 55 of the top plate 54. Similarly to the previously described embodiments, the wall-like head member 50 vibrates to produce a specific sound as the club-head strikes against a golfball.

Figure 7:
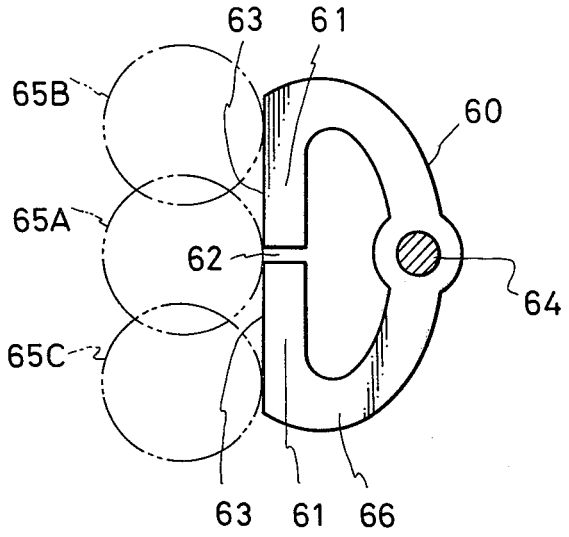
FIG. 7 is a plan view showing another club-head according to the present invention.
Figure 8:
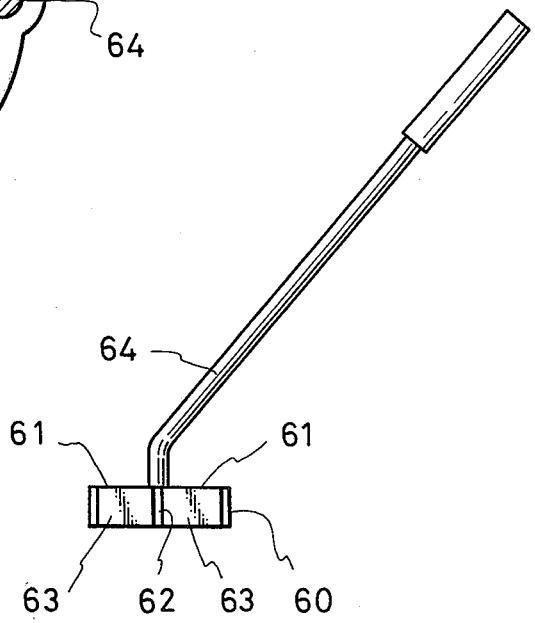
FIG. 8 is a side view of the club-head in FIG. 7 with a shaft connected thereto.

FIGS. 7 and 8 show a tuning fork typed club-head including a substantially reverse C-shaped member 60. The C-shaped head member 60 has two end portions 61 which extend toward each other with their end faces being adjoined to define a slit 62 therebetween. The end portions 61 has flat outside surfaces 63, respectively so that a flat striking face having its central slitted portion will be formed by these end portions 61 of the club-head. A shaft 64 is connected with the club-head at a position corresponding to the slit 62 formed between the end faces of the end portions 61. However, the shaft 64 may be connected with the club-head at the bent end 66 of one of the end portions 61, that is, the connection between that end portion and the main body of the C-shape member 60.

As seen from FIG. 7, the club-head produces a vibratory sound having the largest amplitude when a golfball is struck by the club-head in a position 65A shown by a chain line. On the contrary, the club-head produces other vibratory sounds having smaller amplitude when the golfball is struck by the club-head in the respective positions 65B and 65C shown by chain lines in FIG. 7. Therefore, a golfer can know whether the golfball is hit by the club-head in a proper position thereon. Furthermore the golfer can measure how far the golfball will fly or run through the tone of vibratory sounds, because the tones of vibratory sounds vary depending on the strength of impact given to the club-head when same struck the golfball.

Figure 9:
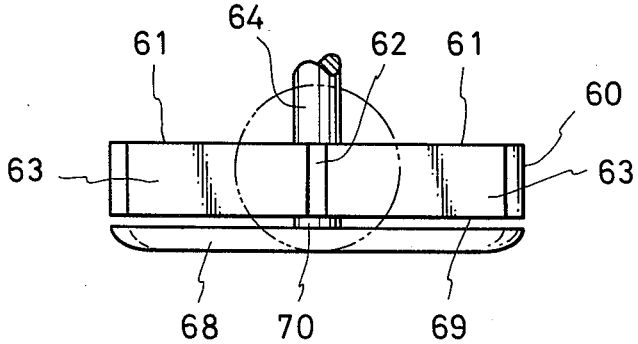
FIG. 9 is a view similar to FIG. 8 showing a modified club-head with a protective bottom plate disposed below the bottom face thereof.

FIG. 9 shows a modified embodiment of the club-head as shown in FIGS. 7 and 8 wherein the club-head has the same structure as that of FIGS. 7 and 8 except that it further includes a protective bottom plate 68 positioned below the bottom face 69 of the C-shaped member 60 and connected to the C-shaped member 60 by means of an extension 70 of the shaft 64. The bottom plate 68 covers substantially the whole of the bottom face 69 of the C-shaped member 60 to prevent the C-shaped member from contacting the ground during shot. Consequently, the club-head will produce a vibratory sound only when it strikes against a golfball.

Figure 10:
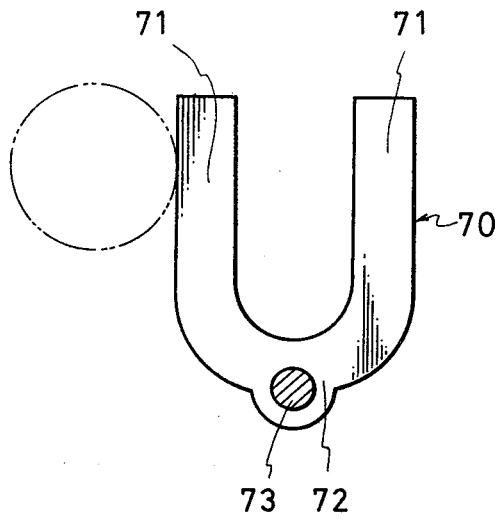
FIG. 10 is a plan view showing still another club-head according to the present invention.

FIG. 10 shows another modified embodiment of the present invention wherein the club-head is comprised of a U-shaped head member 70 having two leg portions 71 and a connecting portion 72 which unites these leg portions 71 at the respective one end thereof to form a well-known tuning fork. In this embodiment, both of the leg portions 71 can be used as the striking part of the club-head. As seen from FIG. 10, the club-head produces a vibratory sound having the largest amplitude when a golfball is struck by the club-head at a position as shown by a chain line. A shaft 73 is connected to the connecting portion 72 of the U-shaped head member 70.

Figure 11:
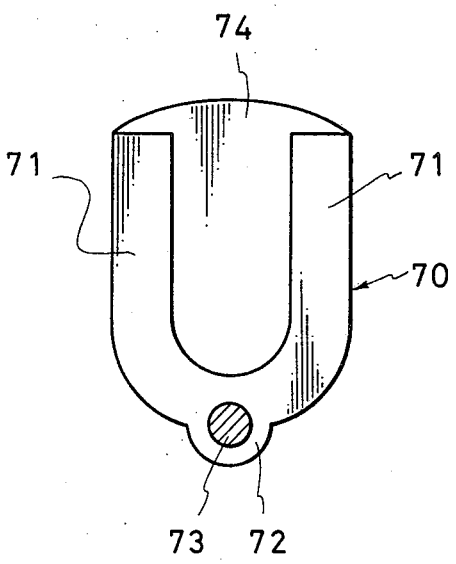
FIG. 11 is a plan view of a club-head modified from that in FIG. 10 with a protective bottom plate disposed below the bottom face thereof.
Figure 12:
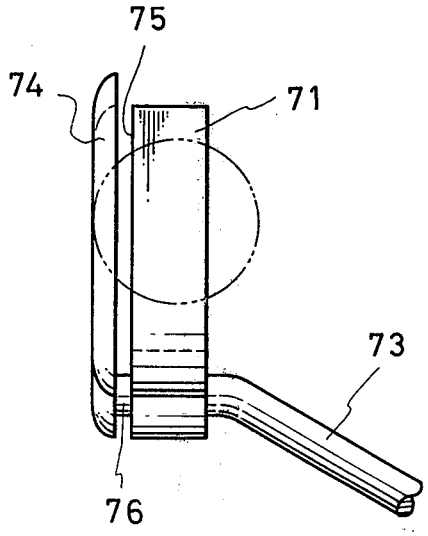
FIG. 12 is a side view of the club-head shown in FIG. 11.

FIGS. 11 and 12 illustrates a protective bottom plate 74 similar to the bottom plate 68 shown in FIG. 9, which is positioned below the bottom face 75 of the club-head and connected to an extension 76 of the shaft 73 to cover substantially the whole of the bottom face 75 of the club-head. It is noted that the free end of each leg portion 71 may be curved toward each other to form substantially an O-shaped head member remaining a slit between the end faces of the leg portions as previously described.

While the preferred embodiments of the present invention have been described with reference to the accompanying drawings, it should be understood that many changes or modifications thereof may be attained by those skilled in the art without departing from the scope of the invention as defined in the appended claims.

I claim:

1. A golfclub comprising a club-head and a shaft, said club-head having two opposed members spaced from one another, each of said opposed members having longitudinal end portions with one end portion of one of said members being integrally joined to one end portion of the other opposed member and the other end portion of said one member being spaced from the other end portion of the other opposed member, the distance between the end portions of said one member being substantially equal to the distance between the end portions of said other member, said opposed members each having an upper edge and a lower edge with each upper and lower edge extending between said end portions of the respective member, said upper edges of said opposed members being spaced from one another, said lower edges of said opposed members being spaced from one another, said one member having a flat striking face adapted to strike a golfball such that said one member vibrates relative to said other member upon striking of said golfball to produce an audible sound indicative of the position on said one member which struck the golfball, said shaft being connected to said other member.

2. A golfclub according to claim 1 wherein said shaft is connected substantially to the mid-section of said other member.

3. A golfclub according to claim 2 wherein one longitudinal end of said one member is joined to one longitudinal end of said other member.

4. A golfclub according to claim 1 wherein said other member has a V-shaped configuration, said shaft being connected to the apex of the V.

* * * * *